US006010267A

United States Patent [19]

Vito

[11] Patent Number: 6,010,267

[45] **Date of Patent: *Jan. 4, 2000**

[54] SQUEEGEE WITH EXTENDED HANDLE AND REMOTE SPRAYING DEVICE

[76] Inventor: John Vito, 519 School St., Clarks Summit, Pa. 18411

[ * ] Notice: This patent issued on a continued prosecution application filed under 37 CFR 1.53(d), and is subject to the twenty year patent term provisions of 35 U.S.C. 154(a)(2).

[21] Appl. No.: 08/931,717

[22] Filed: Sep. 16, 1997

[51] Int. Cl.[7] ..... A47L 1/08; A47L 1/05

[52] U.S. Cl. ..... 401/138; 401/139; 401/140; 401/146

[58] Field of Search ..... 401/146, 140, 401/138, 27, 139; 239/532; 222/174

[56] References Cited

U.S. PATENT DOCUMENTS

| | | | |
|---|---|---|---|
| 622,809 | 4/1899 | Keyser | 401/139 X |
| 1,783,506 | 12/1930 | Homiller | 401/139 |
| 3,377,123 | 4/1968 | Leeson | 401/139 |
| 3,658,432 | 4/1972 | Lanusse | 401/146 X |
| 4,023,711 | 5/1977 | Sena | 222/174 |
| 4,089,440 | 5/1978 | Lee | 222/174 |
| 4,457,472 | 7/1984 | Geberth, Jr. | 239/532 |
| 4,776,716 | 10/1988 | Huang | 401/139 |
| 5,165,811 | 11/1992 | MacLeod | 401/140 X |
| 5,186,392 | 2/1993 | Pleshek | 239/532 |
| 5,364,198 | 11/1994 | Skenderi | 401/140 X |

*Primary Examiner*—Steven A. Bratlie
*Attorney, Agent, or Firm*—John P. Halvonik

[57] ABSTRACT

An extended squeegee and fluid delivery system for cleaning in places that are of high elevation. A squeegee is used in connection with an extended handle. The spray system has a pump that delivers a cleaning agent through a conduit in connection with the squeegee. There is a trigger in connection with the spray bottle and near the end of the handle where the user is holding the handle. The user may then deliver cleaning agent out the nozzle by squeezing on a trigger or pull cord in connection with the handle. The handle of the squeegee may be made hollow in order to deliver the cleaning agent from the source of the agent to the nozzle in connection with the squeegee.

3 Claims, 5 Drawing Sheets

SQUEEGEE WITH EXTENDED HANDLE AND REMOTE SPRAYING DEVICE

BACKGROUND AND FIELD OF THE INVENTION

The invention relates to the field of wiping devices and in particular, to a novel squeegee with an extendible handle and a means for remotely controlling a spray pump mounted on the handle for delivering a cleaning agent upon the surface of the glass where the squeegee will be operating.

PRIOR ART

While there squeegees and spray bottles that are known in the art none of the prior art is known to show the use of a spray bottle in connection with a squeegee having an extended handle in order to deliver cleaning agent to a surface that is some distance away from the user. Typically the user would be standing on the ground and holding the squeegee by the handle. The end of the handle has the squeegee and this end would extend upward in the air for some distance.

SUMMARY OF THE INVENTION

The invention comprises an extended handle in connection with a squeegee. The squeegee may be like a rubber wiper or wiper made of similar materials. A spray system similar to those types of systems used in commercially available spray bottles is incorporated into the handle. The spray system has a pump that delivers the cleaning agent in the bottle and there is a pipe or conduit that delivers the cleaning agent from the bottom of the bottle to a nozzle located at the end of the handle and in connection with the squeegee itself. There is a trigger in connection with the spray bottle and near the end of the handle where the user is holding the handle.

The user may then deliver cleaning agent out the nozzle by squeezing on the trigger or pull cord. In this manner, he can deliver cleaning agent onto the surface of the window, etc. and stand some distance below. The handle of the squeegee may be made hollow in order to deliver the cleaning agent from the source of the agent to the nozzle in connection with the squeegee.

It is an object to provide a squeegee for use on surfaces that are hard to reach and having an extended handle and a means for delivering cleaning agent onto the hard to reach surface.

Another objective is to provide squeegee and cleaning agent delivery system that can be used on hard to reach places.

Another objective is to provide a spray delivery system in close connection with the blade of a squeegee so that one can operate a squeegee and spray cleaning agent without having to switch apparatus or stop the cleaning operation.

Other objectives will be apparent to those skilled in the art once the invention is shown and described. description of drawings FIG. 1 overall construction of sprayer;

FIG. 2 detail of "T" shaped squeegee section;

FIG. 3 sprayer head construction;

FIG. 4 activation system;

FIG. 5 alternate pump type of trigger;

FIG. 6 alternate electrical wiring for electrical activation;

FIG. 7 pivoting sprayer head;

FIG. 8 optional connection of squeegee to front of sprayer.

DESCRIPTION OF THE PREFERRED EMBODIMENT.

Figure 1:
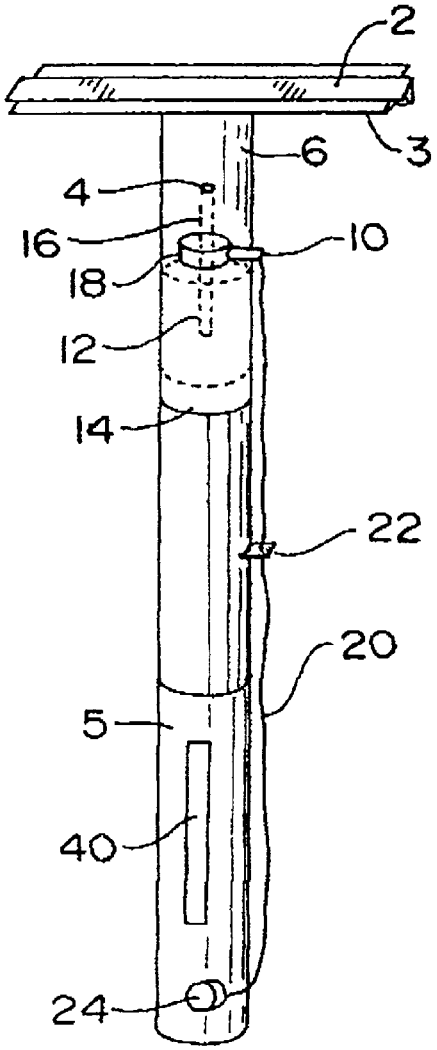

The overall construction of the system is shown in FIG. 1. The lower section of the apparatus is known as the handle 5 may be made constructed of telescoping units that may slide over one another in order that the pole may be extended in length in order for the user to adjust the length of the handle or pole to suit his needs. The other vertical section is the sprayer section 6. A "T" shaped squeegee section 2 is in connection with the top of the sprayer section and forms a "T" with that section. The sprayer section has a nozzle 4 located beneath the squeegee. Together, the sprayer section and the handle or pole make up the majority of the vertical length of the apparatus. The sprayer section holds the reservoir 12 that contains the spraying agent e.g. water, alcohol, glycol, etc. The sprayer section and the handle may be joined to one another by threads 14 or other means.

Figure 3:
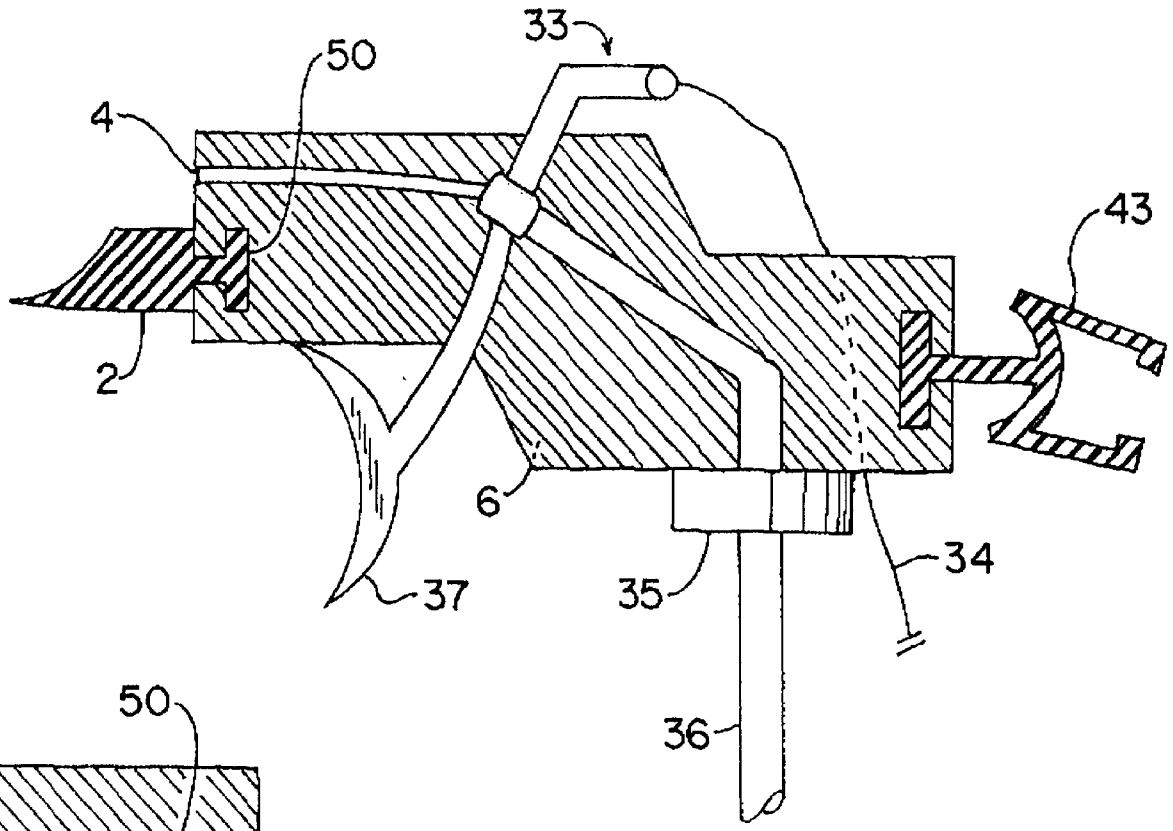
Figure 8:
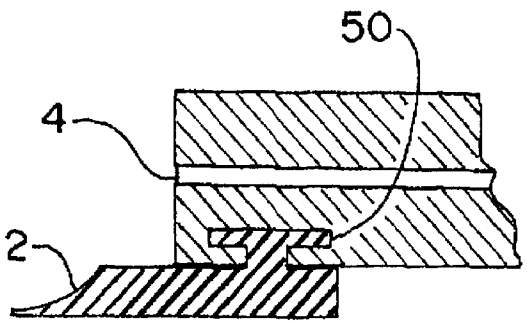

The nozzle 4 of the pump should be in connection with squeegee and is part of the sprayer section 6. It is preferred that the nozzle be below the level of the blade as shown in FIG. 1. Alternately, the blade portion 2 may be constructed below the top of the sprayer section so that the nozzle may be above the blade so that the spray can be delivered to the window without hitting the blade. FIG. 3 and 8 show two optional ways for this arrangement where the blade is below the nozzle.

Details of a sprayer head that may be used with the system are shown in FIG. 3. The blade 2 is in connection with the nozzle 4. The blade may be above or below the nozzle. The conduit 36 is in connection with the trigger 37 that acts as a pump when the trigger is pulled. Threaded portion 35 may be attached to a conventional spray bottle sold commercially in order to provide users with different reservoirs. Alternately, 35 may be attached to a threaded pole section, e.g. section 6 in FIG. 1. In either event, the section that is threaded to 35 will contain the liquid to be sprayed.

A "T" shaped channel 50 may be used in connection with the nozzle 4 in FIG. 3. This channel may be either on the top of the bottom surface of the nozzle and the channel may be used for attachment of various means such as a rubber blade 3, a rigid blade, a clamp, sponge wiper, etc. This channel may be similar to that channel shown in cross section in FIG. 2.

A clamp 43 may be attached to the "T" shaped channel at the other end of this section in order that the clamp may hold a paper towel or similar wiping apparatus. See FIG. 3. The clamp may be of a releasable type e.g. an alligator clip in order to change the wiping means. A pivoting section 33 in connection with a pull line 34 may be used to activate the sprayer when the longer pole section is used. The pull line may be attached to a retractable spool 24 at the end of the pole or may hang free.

The handle sections 5 can, of course, be made much longer than the sprayer section so that the squeegee will be extended for some distance above the user. The handle may be made of sliding sections that can telescope within one another so that the length of the handle may be extended or retracted as needed.

The spray system comprises a source of cleaning agent, e.g. a bottle 12 or some other container; a pump means for moving the cleaning agent by pneumatic force and preferably a conduit 16 that provides that path for the cleaning agent from the source to a nozzle 4 that is in close connection with the squeegee. The end of the sprayer section should contain the squeegee end 2 that is "T" shaped and has a channel on each side for attachment of various means such as a rubber blade 3, a rigid blade, a clamp, sponge wiper, etc.

The spraying system (including reservoir 12, conduit 16 and nozzle 4) may be any state of the art means. Typical systems found in connection with aerosol sprays; squirt guns or bicycle pumps offer suitable examples whose basic construction may be adapted in order to fit into the system described herein. Typically such systems rely on an enclosed container or reservoir that is in connection with a pump 18. The pump is activated by a trigger 10 that the delivers air to the cleaning agent in the container so that the liquid agent is forced through a conduit and out the nozzle of the bottle.

It is important to distinguish the conduit 16 from the handle or pole 5 in the context of this invention. The conduit is likely to be shorter than the handle and capable of carrying a liquid agent. The handle need not be water tight and probably will be made of telescoping units. The conduit may likely parallel the handle for a short distance. The conduit is preferably located inside of the sprayer section 6.

In the preferred embodiment it is thought that the pumping system and the source of cleaning agent may be mounted in the handle and in close connection to the squeegee near the end of the handle. The trigger would be close to the pump itself and thus the trigger would be some distance above the user who may be standing on the ground below the window. The trigger would be in connection with a line 10 or some similar extending member that extends downward from the squeegee and toward the ground. Eyelets 22 may be used on the handle so that the line can be threaded through them and extended to the ground. Thus, the user can activate the trigger from a distance below the trigger by manipulating the line, probably by pulling on the line.

The line 20 may be wound at the bottom of the telescope handle in a retractable spool 24 that takes up slack in the line. The spool would preferably constructed on the interior of the handle section of the device. Thus, the line will be let out as the pole is extended and taken up when the pole is retracted or shortened.

The pull line 20 may also be attached to the trigger without use of the take up spool 24. Eyelets 22 are useful but the line may be used without eyelets. The line could be attached to the trigger and would then dangle freely. The trigger may have an eyelet to attach the pull line, the pull line may have a metal clip on the end of it that will clip into the eyelet on the trigger. The clip at the end of the line will need to be smaller than the eyelets on the side of the spray squeegee and extension pole, so that the clip will pass through these eyelets or thread through the eyelets to reach and clip on the trigger eyelet.

Figure 4:
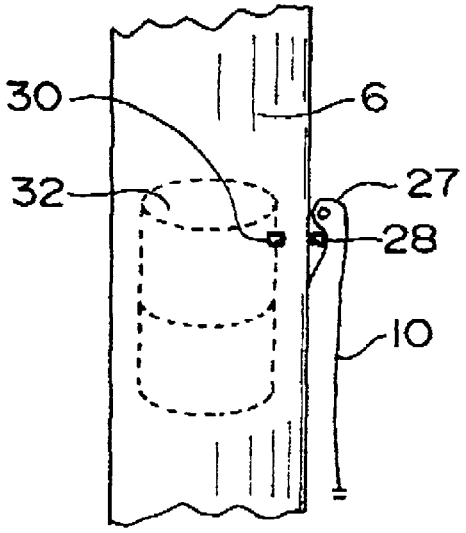
Figure 6:
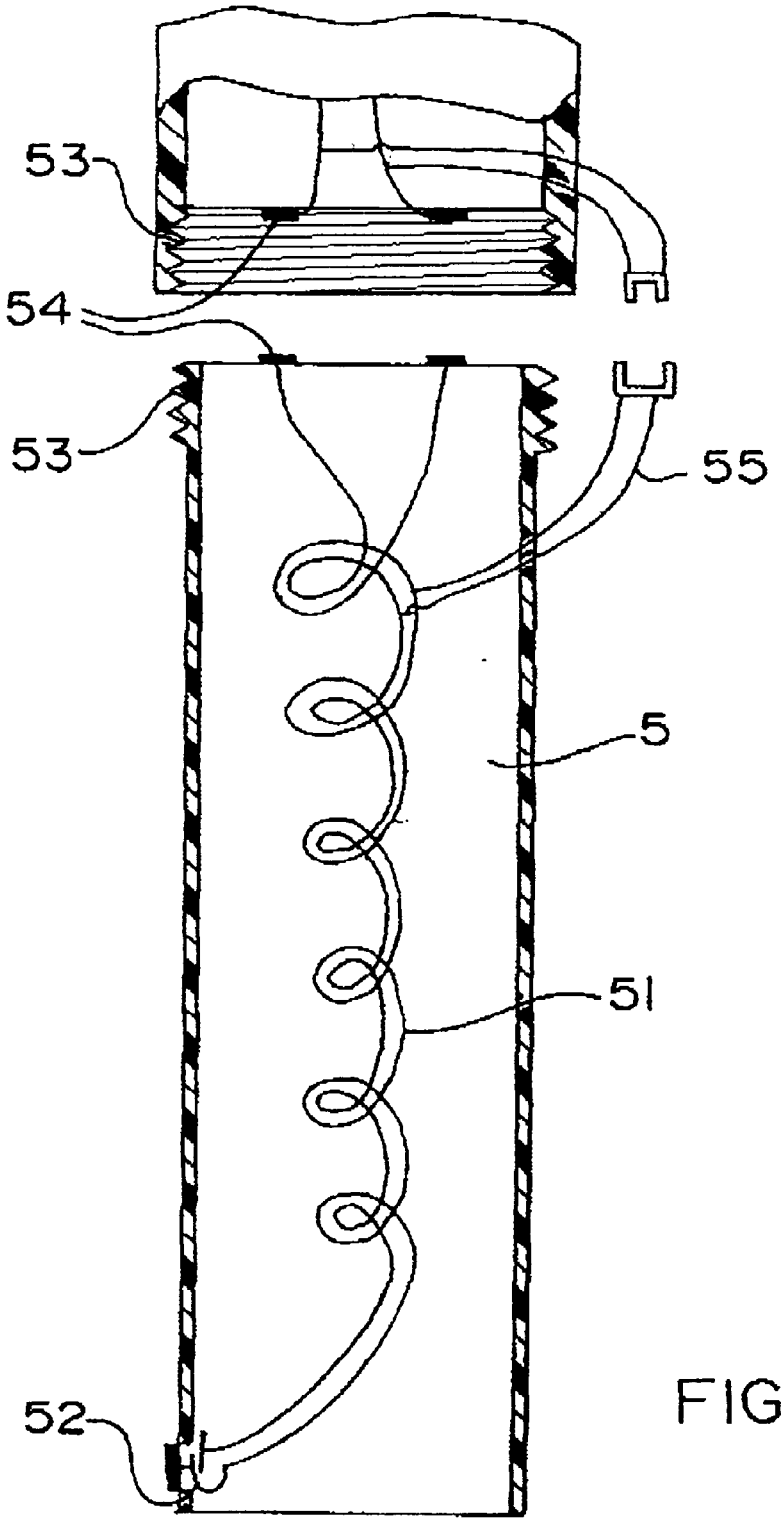

A triggering system for an electric motor operated pump is shown in FIG. 4 and FIG. 6. In FIG. 4 that end of the line in connection with the trigger 10 will pivot on a pin 27. When the line is pulled, this will cause the contact 28 at the end of the line to come in contact with a second contact 30 in order to create an electrical connection that can complete a circuit that will includes a source of electric power (e.g. batteries or electric power cord) and an electric motor 32. The motor will in turn drive the pump when the circuit is completed. Letting up on the line will of course, break the contacts and stop the motor. Other triggering means for the electric motor version may also be used.

FIG. 6 shows a push button switch 52 located at the bottom of the pole and in connection with electric wires 51 that carry a current when the circuit is completed by the switch and this may be used to drive an electric pump in connection with the reservoir. The sections may be connected by threads 53 as in the manual apparatus. Contacts 54 between the sections ensure that the circuit is completed. An optional line 55 having a plug at the end for connection to similar line with a plug may be used to connect the switch 52 to an electric switch mounted in or near the spray trigger and so activate a manual pump by an electric switch.

Figure 7:
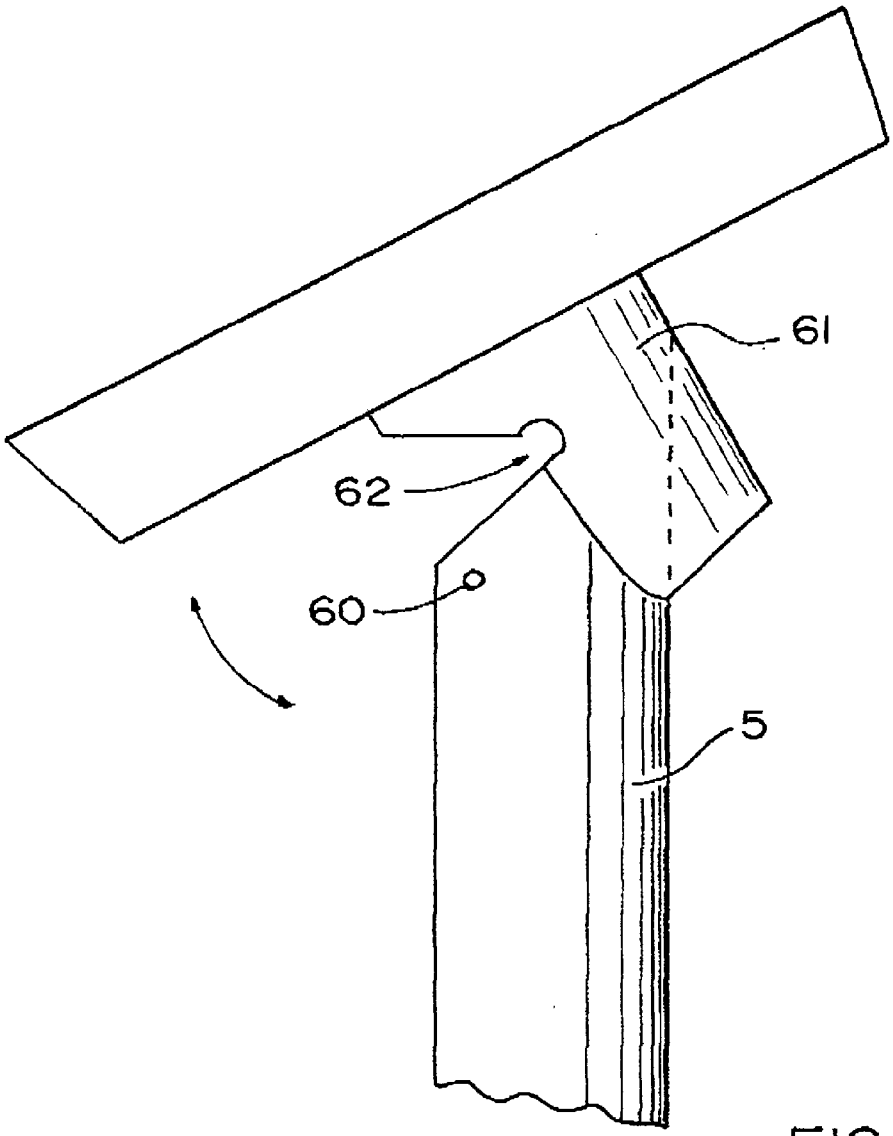

The spraying section of the squeegee may be constructed as a spraying head that pivots at the top of the pole or other vertical support structure. Such construction is shown in FIG. 7 and the lower section of the pivoting head may have a cut out section 62 that corresponds to a pin 61 that fits in the cutout section in order to lock the spray head into place when the device is ready to be used for spraying. When the device is not in use the pivoting head may be folded against the vertical support in order to minimize space for storage purposes. The pivoting movement may be in the direction of the arrow in FIG. 7. Other pivoting constructions are possible without violating the spirit of the invention.

Figure 5:
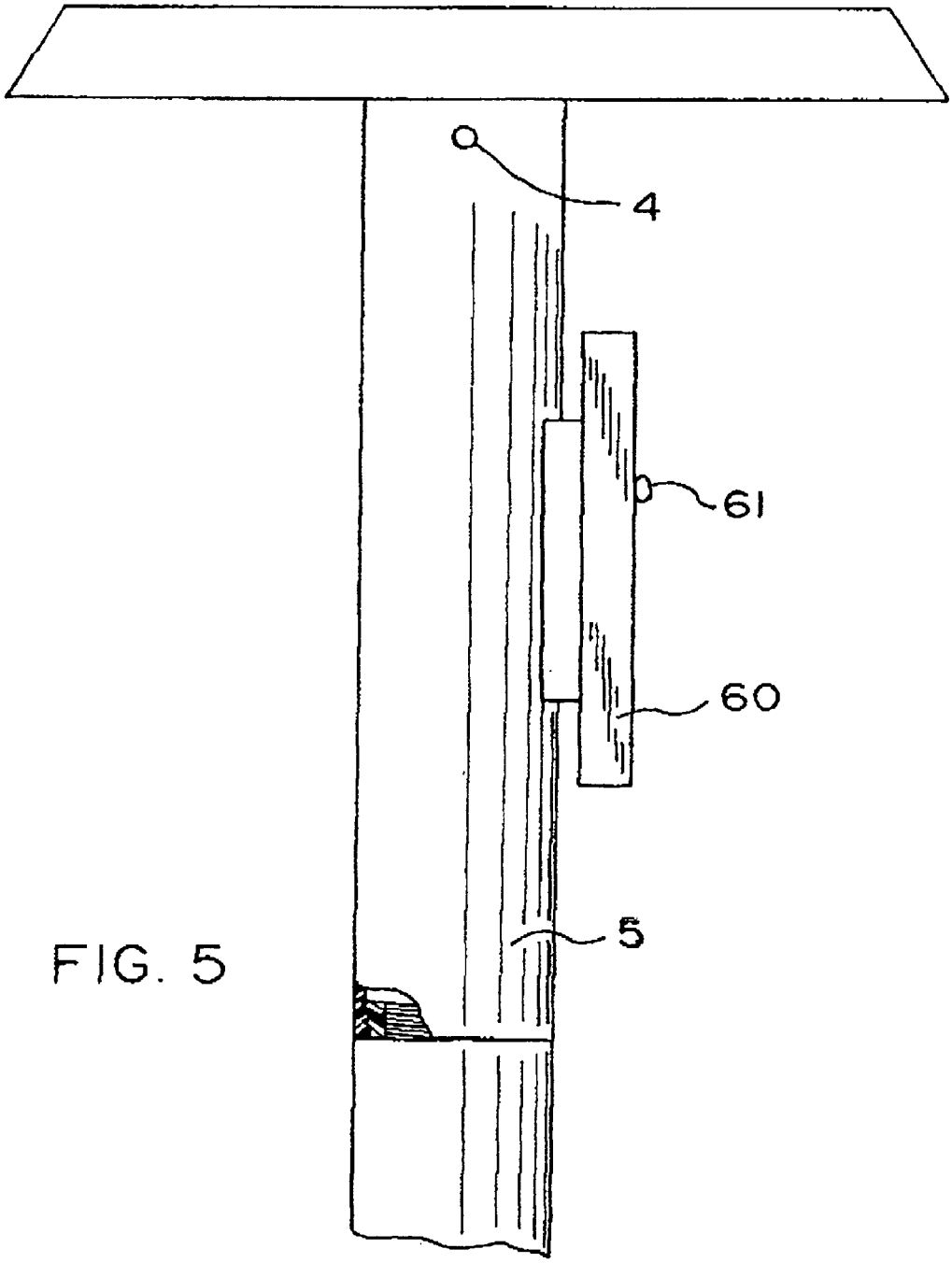

FIG. 5 shows an alternate pump type of trigger, different from that shown in FIG. 1. This pump trigger 60 can be used when the sprayer section 6 is detached from the pole. The trigger is pulled outward to activate a pump that sprays the liquid. The trigger may be spring loaded in order to return the pump trigger to position close to the section 6. An eyelet 61 may be used on the trigger in order to accommodate a pull line that can be used when the other sections are connected for full height.

Figure 2:
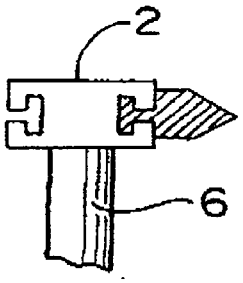

FIG. 2 shows details of the squeegee section. The squeegee may use a standard type sponge scrubber held by a clamp or the scrubber may be made integral with the spraying section without the need for a clamp. It is preferred that each side of the squeegee have a "T" shaped channel in order that various types of scraping means may be attached to the head of the squeegee. Such means include but are not limited to: rubber blades, blades made of harder material such as plastic, clamps that may be attached to the channel to hold a fabric, paper, or sponge or similar devices within the clamp; sponges may also be fed into the "T" shaped channel. Such channel construction is typical in state of the art bladed devices.

The use of a second channel on the other side of the squeegee head will allow for two types of wipers (say for example a sponge and a blade) to be mounted at the top of the squeegee for dual usage. The user can simply rotate the handle 180° to expose the paper, etc. to the window and thus wipe dry the surface from the remote location. In addition, the pole section may include a similar "T" shaped channel 40 (see FIG. 1) in order to store the various attachments when they are not in use on the squeegee head. The "T" shaped channel can then be used to store the blades, the clamp, the sponge, etc.

It is also possible to make the sprayer section as the outer wall of a bottle that holds the spraying agent. In that case, the bottom of the bottle needs to have threads to accommodate similar threads on the pole or telescoping pole sections. A non-telescoping pole may be used by mounting the pole into the bottom of the bottle as stated above. This non telescopic extension pole could be used in this manner with the original style spray squeegee.

The spraying action of the reservoir may be operated remotely by an electric motor in connection with the vertical support. The motor may use an electric cord or may be battery powered. Electric motor will be placed near the cleaning fluid reservoir, a switch or button can be operated from this end of spray squeegee without the extension pole. This could also be operated with the extension pole where by a remote switch will be mounted at the bottom end of the pole. Although the motor would be located near the reservoir or in it, metal contacts will be on the screw end of the reservoir handle and to make contact with switch contacts from the extension handle position wire will be run inside the extension pole from the switch to the contacts where it will meet with contacts from the battery motor.

The invention may use rubber weather connectors in place of metal contacts at the point where the squeegee reservoir handle meets with the extension telescope pole. The wire that is run inside telescopic will be coiled to accommodate the changes in length when the telescopic pole is adjusted to length. Rechargeable battery unit can be used, it could also make the spray squeegee with an interior totally enclosed battery unit to plug in a wall socket meaning spray unit will have external prongs that fold when unit is in use and flip out to plug spray squeegee in to a wall socket.

In this manner, the spray delivery system can deliver the stream of cleaning agent to the window even though the user is standing some distance away from the window. It is thought that a spray delivery system that relies on a very long conduit would likely be impractical as it would require a very strong pump to overcome the force of gravity were the conduit to be similar in length to the handle. Therefore the use of the reservoir within the sprayer section 6 is believed to decrease the length of the conduit. By using the line that extends from the trigger, the length of the conduit that carries the cleaning agent will be reduced and the delivery of the agent made practical. The use of the line will also enable the sprayer to be used for such tasks as cleaning windows, etc. that are at a height above the user. The extension pole and the pull line can be disconnected from the spray section for tasks that do not require the extension pole and the remote triggering. The spray section could then be used by itself. The user would then squeeze the trigger with their fingers or use the push pull trigger.

In addition to the trigger and line system the pump may also be activated by an optional pump delivery system. In this embodiment, a hand pump may be connected to the handle and fixed for sliding motion upon the handle. The hand pump is in connection with a pneumatic system that will deliver a pressurized stream of air to the container with cleaning agent upon the movement of the hand pump. In this manner, the cleaning agent will be delivered to the nozzle upon the user pumping the handle.

Optionally, the container may have a lid or screw top so that the interior can be accessed for refilling the container.

I claim:

1. A remotely operable spraying and squeegee system comprising: a handle having a threaded section at one end and extending in a lengthwise direction, a squeegee section having a threaded section for connection to said threaded section of said handle, said handle made of telescoping sections so that said handle may be extended in length, said squeegee section having an enclosed container for holding liquid, said enclosed container having a threaded neck, a sprayer head in connection with said squeegee section and having a threaded cap adapted for engagement with said threaded neck, said sprayer head having a delivery system for dispensing said liquid, said delivery system comprising a delivery nozzle at one end of said sprayer head, a conduit in connection with said delivery nozzle and extending through said threaded cap and into said enclosed container, a trigger in connection with said conduit and having a means to induce a drop in pneumatic pressure in said conduit sufficient to draw liquid into said conduit and out of said nozzle, said sprayer head having a squeegee blade fixed to said sprayer head in a manner so that said squeegee blade is perpendicular to said lengthwise direction; said squeegee blade aligned with said nozzle in a manner so that said squeegee blade is below said nozzle when said squeegee section is attached to said handle.

2. The apparatus of claim 1 wherein said trigger pivots upon a pivot point and has an extended portion, said extended portion extending in a direction beyond said pivot point and in a direction opposite said handle, said trigger having a flexible line in connection with said extended portion, said flexible line in connection with said handle and having means for maintaining said line in a direction parallel to said lengthwise direction.

3. The apparatus of claim 2 wherein said sprayer head has a clamping means connected to said head at a side opposite said squeegee blade, said clamping means for periodically holding and releasing a wiping material.

* * * * *